US006554580B1

(12) United States Patent
Mayfield et al.

(10) Patent No.: US 6,554,580 B1
(45) Date of Patent: Apr. 29, 2003

(54) PLUNGER FOR WELL CASINGS AND OTHER TUBULARS

(75) Inventors: Windel O. Mayfield, Brownwood, TX (US); Robert L. Moore, Perryton, TX (US)

(73) Assignee: PAAL, L.L.C., Oklahoma Ctiy, OK (US)

( * ) Notice: Subject to any disclaimer, the term of this patent is extended or adjusted under 35 U.S.C. 154(b) by 0 days.

(21) Appl. No.: 09/922,023

(22) Filed: Aug. 3, 2001

(51) Int. Cl.[7] ..... F04B 47/12; E21B 33/12; E21B 33/00

(52) U.S. Cl. ..... 417/56; 417/59; 166/101; 166/333.1

(58) Field of Search ..... 417/56, 59, 555.2; 166/106, 101, 333.1

(56) References Cited

U.S. PATENT DOCUMENTS

| | | | | |
|---|---|---|---|---|
| 1,790,450 A | | 1/1931 | Torrance | |
| 2,674,951 A | * | 4/1954 | Zaba | 417/392 |
| 2,688,928 A | | 9/1954 | Vincent et al. | |
| 2,830,540 A | | 4/1958 | Vincent | |
| 2,850,339 A | | 9/1958 | Vincent | |
| 3,147,808 A | | 9/1964 | McCarvell et al. | |
| 3,273,504 A | | 9/1966 | Lyles | |
| 4,070,134 A | | 1/1978 | Gramling | |
| 4,363,606 A | | 12/1982 | Kilgore | |
| 4,531,891 A | | 7/1985 | Coles | |
| 4,696,624 A | * | 9/1987 | Bass et al. | 417/56 |
| 4,813,485 A | * | 3/1989 | Coyle | 166/105 |
| 4,923,372 A | | 5/1990 | Ferguson et al. | |
| 4,986,727 A | | 1/1991 | Blanton | |
| 5,086,839 A | * | 2/1992 | Setterberg et al. | 165/DIG. 442 |
| 5,253,713 A | * | 10/1993 | Gregg et al. | 166/372 |
| 5,427,504 A | | 6/1995 | Dinning et al. | |

* cited by examiner

*Primary Examiner*—Charles G. Freay
*Assistant Examiner*—Timothy P. Solak
(74) *Attorney, Agent, or Firm*—Fellers, Snider, Blankenship, Bailey & Pippens, P.C.

(57) ABSTRACT

A plunger for well casings and other tubulars comprising: An elongate body having a flow passage with a lower inlet port and an upper outlet port; an internal valve positioned between the ports; at least one first flexible sealing member positioned around the body below the outlet port; an actuator which urges the first sealing member against the interior wall of the casing when the valve is closed; at least one second flexible sealing member positioned around the body and providing an outwardly expandable sealing chamber; and at least one flow port positioned below the valve and providing fluid communication between the flow passage and the sealed chamber. The second flexible sealing member(s) being outwardly expandable by increasing pressure in the sealed chamber.

14 Claims, 3 Drawing Sheets

PLUNGER FOR WELL CASINGS AND OTHER TUBULARS

FIELD OF THE INVENTION

The present invention relates to plungers operable for lifting fluids in well casings or other tubulars from subterranean formations.

BACKGROUND OF THE INVENTION

Various types of casing plungers have been used heretofore for lifting and recovering or removing oil, water, or other fluids from well casings. In some wells, due to relatively low formation pressures and/or other formation conditions, liquids tend to accumulate at some level in the well casing rather than flowing naturally out of the well. Casing plungers offer potential benefits over conventional pumps, submersible pumps, and other power operated devices for recovering or removing such fluids.

One type of casing plunger currently available comprises: an elongate housing assembly; one or more external sealing devices which project from the housing and sealingly contact the well casing as the plunger travels up and down in the well; a flow passage extending through the assembly and having openings below and above the external seal(s); and a valve assembly for opening and closing the flow passage.

In a typical production cycle wherein a casing plunger is used to recover or remove accumulated liquids from a well casing, the plunger is dropped from the upper end of the well casing with the plunger valve in open position. The fluid accumulated in the casing will thus flow internally through the housing flow passage so that the plunger will fall to a desired downhole position. The desired downhole position can be set, for example, by placing a stop structure in the well casing.

Upon reaching the desired downhole position, the plunger valve typically will close so that the plunger will effectively seal the casing. As formation gas builds beneath the sealed plunger, the pressure beneath the plunger increases. Eventually, the pressure beneath the plunger will increase to the point that the plunger will begin to rise in the casing, thus lifting the column of fluid on top of the plunger toward the surface and into an overhead product line. Upon reaching the top of the well, the plunger valve opens so that the pressure beneath the plunger is released and the plunger is ready for another production cycle.

Unfortunately, the casing plunger devices heretofore known in the art have had significant shortcomings. As indicated, for example, in U.S. Pat. No. 4,923,372, external elastomeric-type sealing elements are particularly desirable for sealing the gap between the plunger housing and the interior wall of the well casing. However, the continuous contact of the elastomeric seal with the casing wall as the plunger travels up and down in the well casing can cause the elastomeric seals to wear very rapidly, thus requiring frequent repair and replacement and sometimes resulting in valve failure. Alternatively, other prior art devices employ sealing elements which are mechanically engaged with the well casing as the plunger moves upward within the well but are supposed to be mechanically disengaged from the casing wall as the plunger falls downward. In practice, however, these devices typically bounce against the interior wall of the casing as they fall through the well, thus causing significant wear and damage to the exterior components of the plunger.

SUMMARY OF THE INVENTION

The present invention provides a plunger for well casings and other tubulars which satisfies the needs and alleviates the problems discussed above. In one aspect, the inventive plunger comprises: a body having a flow passage, the flow passage having at least one inlet port and at least one outlet port positioned above the inlet port; a valve positioned in the flow passage (preferably in the upper portion of the tool) between the outlet port and the inlet port; a flexible sealing member retained around the body; and an actuator engaging the flexible sealing member such that, when the valve is closed, the actuator will urge the flexible sealing against the interior wall of the well casing.

In another aspect, the inventive plunger comprises: an elongate body having a flow passage, the flow passage having at least one inlet port and at least one outlet port positioned above the inlet port; a valve positioned in the flow passage between the outlet port and the inlet port; a first flexible sealing member positioned around the body below the outlet port; an actuator operably linked to the flexible sealing member such that, when the valve is closed, the actuator will cause the flexible sealing member to contact and seal against the well casing; a second flexible sealing member positioned around the body and providing an outwardly expandable sealed chamber around the body; and at least one flow port, positioned below the valve, providing fluid communication between the flow passage and the sealed chamber. The second flexible sealing member is outwardly expandable by increasing pressure in the sealed chamber such that the second flexible member will contact and seal against the well casing.

Further objects, features, and advantages of the present invention will be apparent to those skilled in the art upon examining the accompanying drawings and upon reading the following description of the preferred embodiments.

DETAILED DESCRIPTION OF THE PREFERRED EMBODIMENTS

Figure 1:
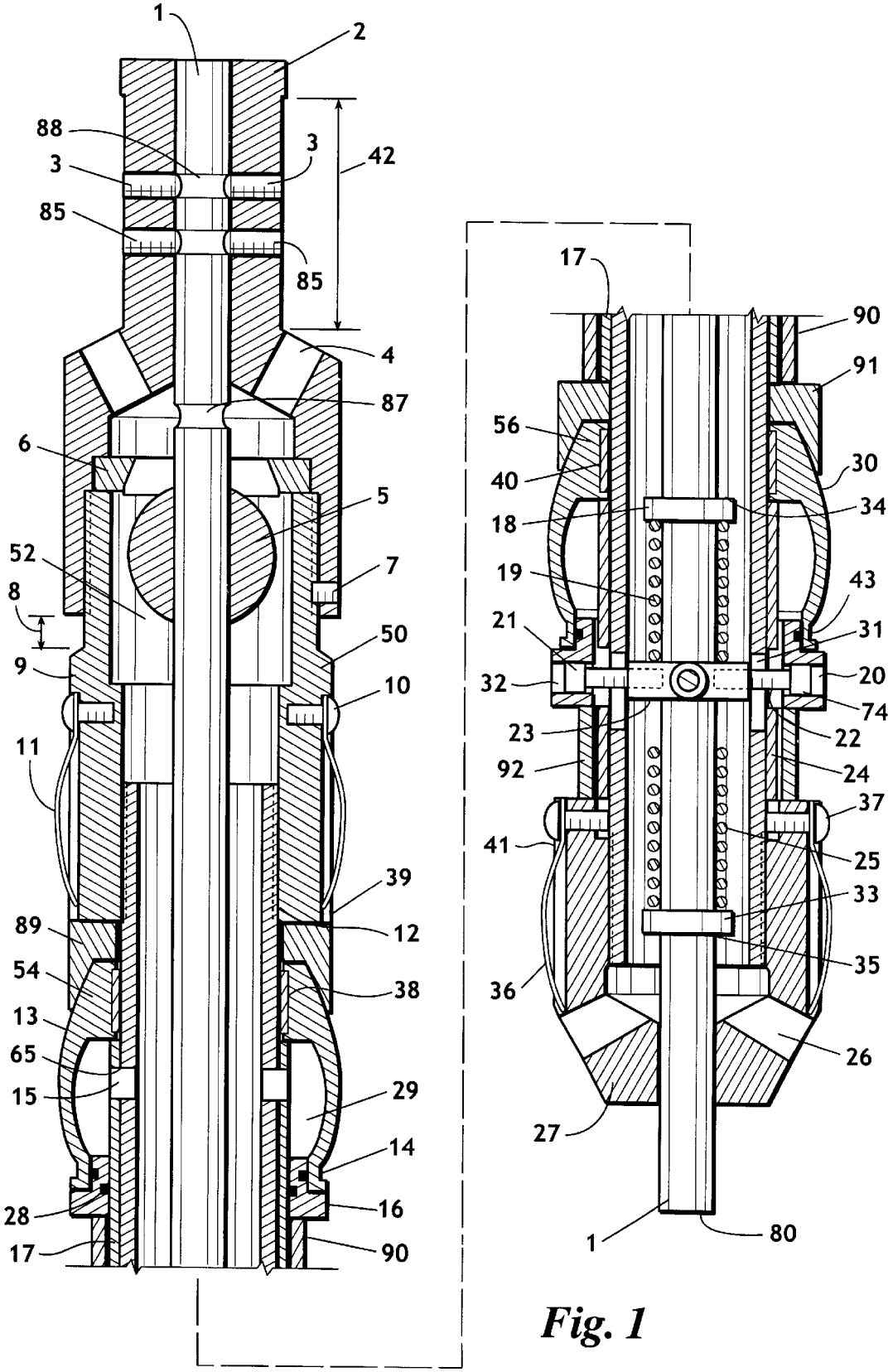
FIG. 1 is a cutaway elevational side view of one embodiment of the inventive casing plunger.
Figure 2:
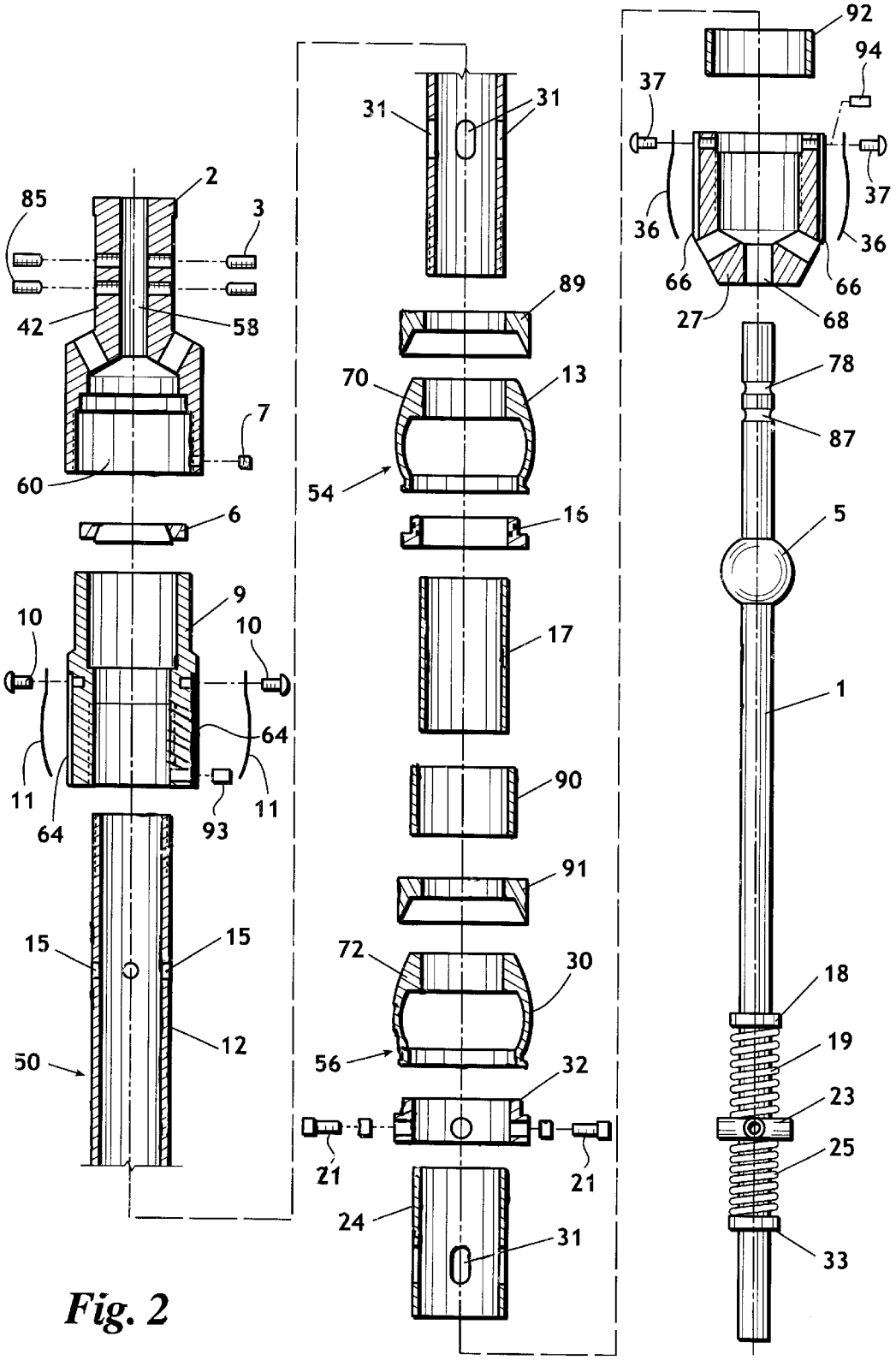
FIG. 2 is an exploded, cutaway elevational side view of the inventive plunger.
Figure 3:
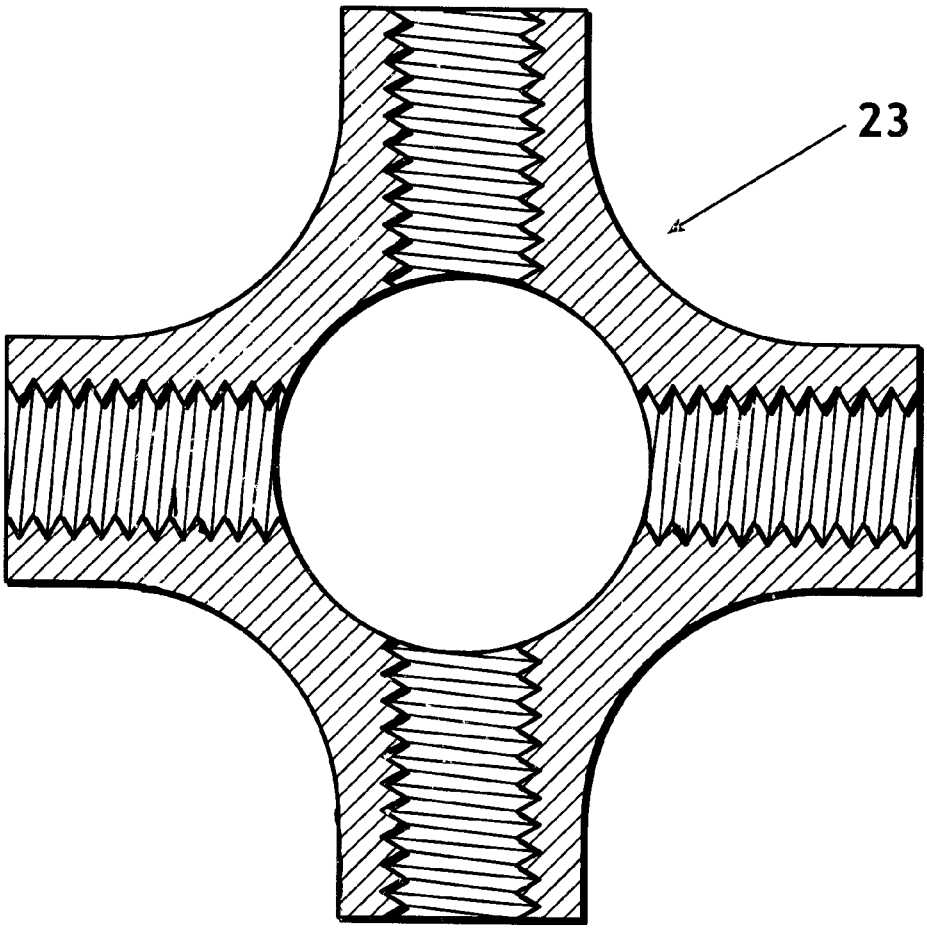
FIG. 3 is a plan view of a shift spider element 23 employed in the inventive plunger.

An embodiment of the inventive casing plunger is depicted in FIGS. 1–3. The inventive plunger comprises: an elongate body assembly 50; an elongate valve rod 1 slidably extending through body assembly 50; a flow channel 52 extending through the interior of body assembly 50; a valve element 5 (e.g., a spherical valve element, a conical element, a combination spherical and conical element, or other type of valve element) secured to valve rod 1 and positioned within flow channel 52; a valve seat ring 6 retained within flow channel 52 and sized and shaped for receiving valve element 5 to thereby close flow channel 52; one or more inlet flow ports 26 extending from the lower end of flow channel 52 through the lower end portion of body assembly 50; one or more outlet flow ports 4 positioned above valve seat 6 and extending from the upper end of flow channel 52 through the upper portion of body assembly 50; an upper elastomeric sealing cup assembly 54 secured on the exterior of body assembly 50 at a position spaced below outlet flow ports 4 and valve seat 6; a lower elastomeric sealing cup assembly 56 secured on the exterior of body assembly 50 below upper sealing cup assembly 54; a plurality of optional bow-type centralizer drag springs 11 projecting from body assembly 50 above upper sealing cup assembly 54; a plurality of optional bow-type centralizer drag springs 36 projecting from body assembly 50 beneath lower sealing cup assembly 56; and an actuating mechanism 74 for actuating lower sealing cup assembly 56 as valve rod 1 moves valve 5 to its closed position.

Elongate body assembly 50 comprises: an upper cap 2 having outlet flow port(s) 4 formed therethrough and an upper fishing neck 42; a body adaptor 9 threadedly connected to the lower end portion of upper cap 2; a set screw 7 for locking the threaded connection between body adaptor 9 and upper cap 2; a body tube 12 threadedly secured to the lower end portion of body adaptor 9; a set screw 93 locking the threaded connection between body tube 12 and body adaptor 9; a lower shoe 27 threadedly attached to the lower end portion of body tube 12 and having lower flow port(s) 26 formed therethrough; and a set screw 94 for locking the threaded connection between lower shoe 27 and body tube 12.

The fishing neck 42 of upper cap 2 has a central bore 58 formed therethrough for guiding the sliding movement of valve rod 1. A central hole 68 is also provided through the bottom of lower shoe 27 for guiding the sliding movement of valve rod 1. Internal valve seat 6 is clamped between the upper end of body adaptor 9 and an interior radial shoulder 60 formed in upper cap 2. The lower end of upper cap 2 is positioned adjacent to an exterior radial shoulder formed on body adaptor 9 to thereby provide an external slot 8 extending around the inventive plunger. As discussed hereinbelow, slot 8 is a catcher slot used for holding and launching the inventive device.

Longitudinal recess grooves 64 are formed in the exterior of body adaptor 9 for receiving upper bow springs 11. Bow springs 11 are retained in recess grooves 64 by machine screws 10. In the same manner, lower bow springs 36 are retained by machine screws 37 in longitudinal recess grooves 66 formed in lower shoe 27.

The upper sealing cup assembly 54 preferably comprises: at least one elastomeric sealing cup 13 having an upper collar 70 which is positioned around body tube 12; an upper cup thimble 89 positioned around body tube 12 for receiving the collar 70 of sealing cup 13 and which abuts the lower end of body adaptor 9; a seal-retaining ring 16, positioned around an upper spacer sleeve 17 provided over body tube 12, for retaining the lower circular end of sealing cup 13; a clamp ring 14 which sealingly secures the lower end of cup 13 to retaining ring 16; and an O-ring or other sealing member 28 for sealing retaining ring 16 around upper spacer sleeve 17. The sealing of the lower circular end of sealing cup 13 by retaining ring 16, clamp ring 14, and O-ring 28 results in the formation of a sealed pressure chamber 29 within sealing cup 13.

In a manner similar to upper sealing cup assembly 54, the lower sealing cup assembly 56 preferably comprises: at least one elastomeric sealing cup 30 having an upper collar 72; a lower cup thimble 91 which receives the collar 72 of sealing cup 30 and abuts against the lower end of upper spacer sleeve 17; a retaining ring 32 for retaining the lower circular end of cup 30 around body tube 12; and a clamp ring 43 for securing the lower end of sealing cup 30 to retaining ring 32.

In addition to upper spacer sleeve 17, the inventive plunger preferably includes a lower spacer sleeve 24. Upper spacer sleeve 17 is positioned around body tube 12 within upper cup retaining ring 16 and extends from the upper end of lower cup collar 72 to the lower end of upper cup collar 70. Lower spacer sleeve 24 is positioned around body tube 12 within lower cup retaining ring 32 and extends from the upper end of lower shoe 27 to the lower end of the collar 72 of lower sealing cup 30. Thus, when lower shoe 27 is securely attached to body tube 12, upper sleeve 17 and lower sleeve 24 act to clamp the collars 70 and 72 of elastomeric cups 13 and 30. The compression of the elastomeric cups by spacer sleeves 17 and 24 is effective to seal the upper ends of cups 13 and 30 around body tube 12 and to seal the ends of spacer sleeves 17 and 24. The inventive plunger preferably further comprises an upper retaining ring stop sleeve 90 positioned between upper cup retaining ring 16 and lower thimble 91 and a lower stop sleeve 92 positioned between retaining ring 32 and lower shoe 27.

One or more apertures 65 provided in upper spacer sleeve 17 are sized and positioned to align with corresponding ports 15 formed through body tube 12 to thereby provide lateral fluid passages from interior flow channel 52 to the pressure chamber 29 provided beneath upper elastomeric cup 13.

The actuating mechanism 74 for automatically engaging and releasing lower sealing cup 30 preferably comprises: a shift spider 23 positioned in flow channel 52 and retained on valve rod 1 between an upper valve opening spring 19 and a lower actuating spring 25; a spring collar 18 and a snap ring or other locking device 34 which retain the upper end of opening spring 19 on valve rod 1; a spring collar 33 and snap ring 35 which retain the lower end of actuating spring on valve rod 1; a spiral wound retaining ring 20 positioned within an interior groove formed in lower cup retaining ring 32; and a plurality of screws 21 extending through a bushing 22 from the internal shift spider 23 to exterior retaining ring 32 via a corresponding number of longitudinal slots 31 formed through body tube 12 and through lower spacer sleeve 24.

As will be understood by those skilled in the art, the inventive plunger can be retained at the top end of the well casing by a lubricator assembly (not shown) or other structure having a catch mechanism receivable in the external catcher slot 8 of the inventive device. When the inventive plunger is positioned at the top of the well at the beginning of the production cycle, the valve element 5 of the inventive device is retained in the open position depicted in FIG. 1 by detent screws 3 extending radially into the neck 42 of upper cap 2. Detent screws 3 are releasably received in a groove 78 formed in the upper end portion of valve rod 1. When valve 5 and valve rod 1 are secured in the open position depicted in FIG. 1, the lower end 80 of valve rod 1 projects from the bottom opening 68 of lower shoe 27.

When released by the catch mechanism, the inventive plunger will fall downwardly through the well casing. Drag springs 11 and 36 slide against the interior wall of the casing, slow the descent of the plunger, and guide and center the inventive plunger as it falls such that the plunger does not bounce against the interior wall of the casing. Although not essential, the outside diameters of sealing cups 13 and 30 are preferably not greater than, and are more preferably less than, the inside diameter of the well casing such that no significant wear of the sealing cups will occur as the inventive plunger falls through the casing. When the plunger reaches the column of liquid which has accumulated within the casing, the liquid flows through the internal flow channel 52 and through valve seat 6 of the plunger so that the plunger will continue to fall through the casing.

The downward travel of the inventive plunger continues until the plunger reaches a downhole stop structure (not shown) secured at a desired downhole position within the casing. As the inventive plunger travels downwardly, the protruding lower end 80 of valve rod 1 will eventually strike the downhole stop structure. At the same time, the weight and downward momentum of the plunger body assembly 50 will force valve rod 1 to slide upwardly within the body assembly, thus disengaging the detent screws 3 from detent groove 88 and causing valve element 5 to seal against valve seat 6. Valve rod 1 also carries shift spider 23, actuation screws 21, and the clamp ring 43 of lower sealing cup assembly 56 upward such that lower elastomeric cup 30 deflects outwardly and seals against the interior wall of the casing. To assist in holding valve element 5 in engagement with valve seat 6 until sufficient pressure builds beneath the plunger to keep the valve closed, additional detent screws 85 are provided in the neck 42 of upper cap 2 for releasable engagement with a second groove 87 formed around valve rod 1.

When the valve element 5 is closed and the lower sealing cup 30 is flexed outwardly in sealing position, the inventive plunger effectively seals the casing and blocks all upward flow. Consequently, formation gas pressure within the sealed interior of the plunger and in pressure chamber 29 will increase such that upper elastomeric sealing cup 13 is also eventually caused to expand outwardly and seal against the interior wall of the casing. Internal pressure also assists in holding and sealing lower cup 30 against the casing wall.

As the gas pressure beneath the inventive plunger continues to increase, the plunger is eventually forced to rise within the casing, thus lifting the column of fluid above the plunger and forcing it toward the surface and into an overhead product line (not shown). When traveling upwardly through the well casing with valve element 5 and valve rod 1 in their closed positions, the upper end of valve rod 1 projects from the top opening of upper cap 2. When the plunger eventually reaches the lubricator assembly at the top of the well, the protruding upper end of valve rod 1 strikes the lubricator such that valve rod 1 and spherical valve element 5 are returned to the open positions depicted in FIG. 1. As the valve opens, the gas accumulated beneath the plunger is allowed to flow through the plunger flow channel 52 and into the overhead product line. At the same time, actuating mechanism 74 releases the lower elastomeric sealing cup 30 and the sealing pressure within upper sealing cup 13 is released. Thus, the plunger is returned to its original open position and is ready for another cycle through the well casing.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A plunger for well casings and other tubulars having an interior wall comprising:

a plunger body having an interior flow passage, said interior flow passage having at least one inlet port and at least one outlet port positioned above said inlet port;

a first valve element positioned in said interior flow passage between said outlet port and said inlet port;

a valve rod slidably provided in said plunger body;

a second valve element positioned on said valve rod for engaging said first valve element to close said interior flow passage when said valve rod moves to a closing position;

a flexible sealing member positioned around said plunger body below said outlet port, said flexible sealing member having at least one longitudinal end; and an actuator comprising a plurality of legs extending radially from said valve rod through apertures provided in said plunger body such that, when said valve rod moves to said closing position, said legs will move said one longitudinal end in a longitudinal direction on said plunger body effective to flex said flexible sealing member uniformly outward around said plunger body.

2. The plunger of claim 1 wherein said flexible sealing member comprises an elastomeric sealing cup.

3. The plunger of claim 2 wherein:

said elastomeric sealing cup includes an upper collar positioned around said plunger body;

said one longitudinal end is a lower circular end of said elastomeric sealing cup positioned around said plunger body; and said lower circular end of said elastomeric sealing cup is secured to a seal retaining ring slidably positioned around said plunger body.

4. The plunger of claim 1 further comprising a plurality of exterior guide members provided on said plunger body and positioned such that said guide members will guide said plunger and center said plunger as said plunger descends within said interior wall so that, as said plunger descends, said flexible sealing member will not substantially contact said interior wall.

5. The plunger of claim 1 further comprising a plurality of exterior bow springs positioned on said plunger body in a manner effective such that said bow springs will remain in contact with said interior wall to center said plunger while allowing said plunger to descend gravitationally within said interior wall.

6. The plunger of claim 1 wherein each of said legs comprises a screw which extends through one of said apertures provided in said plunger body.

7. A plunger for well casings and other tubulars having an interior wall comprising:

an elongate body having a lateral outer circumference and an interior flow passage, said interior flow passage having at least one inlet port and at least one outlet port positioned above said inlet port;

a first valve element positioned in said interior flow passage between said outlet port and said inlet port;

a valve rod slidably positioned in said elongate body;

a second valve element positioned on said valve rod for engaging said first valve element to close said interior flow passage when said valve rod moves to a closing position;

a first flexible sealing member positioned around said elongate body below said outlet port, said first flexible sealing member having at least one longitudinal end;

an actuator operated by said valve rod for moving at least said one longitudinal end in a longitudinal direction on said elongate body effective to compress said first flexible sealing member such that said first flexible sealing member will flex uniformly outward around said lateral outer circumference of said elongate body;

a second flexible sealing member positioned around said elongate body and providing an outwardly expandable sealed chamber around said elongate body; and at least one flow port positioned below said first valve element and providing fluid communication between said interior flow passage and said sealed chamber, wherein, when said valve rod moves to said closing position and said second valve element engages said first valve element, said actuator will also be operated to flex said first flexible sealing member outwardly into engagement with said interior wall such that fluid flow both around and through said elongate body will be blocked in a manner effective for producing a pressure increase within said expandable sealed chamber which will cause said second flexible sealing member to expand outwardly into engagement with said interior wall.

8. The plunger of claim 7 wherein said first flexible sealing member comprises an elastomeric sealing cup.

9. The plunger of claim 8 wherein:

said elastomeric sealing cup includes an upper collar positioned around said elongate body;

said one longitudinal end is a lower circular end of said elastomeric sealing cup positioned around said elongate body; and said lower circular end of said elastomeric sealing cup is secured to a seal retaining ring slidably positioned around said elongate body.

10. The plunger of claim 7 further comprising a plurality of exterior guide members provided on said body and positioned such that said guide members will guide said plunger and center said plunger as said plunger descends within said interior wall so that, as said plunger descends, said first and said second flexible sealing members will not substantially contact said interior wall.

11. The plunger of claim 7 wherein:

said second flexible sealing member comprises an elastomeric sealing cup having an upper collar positioned around said elongate body and a lower circular end positioned around said elongate body and said outwardly expandable sealed chamber is provided within said elastomeric sealing cup between said upper collar and said lower circular end.

12. The plunger of claim 11 wherein said pressure increase will cause said elastomeric sealing cup to expand uniformly outwardly around said lateral outer circumference of said elongate body.

13. The plunger of claim 7 further comprising a plurality of exterior bow springs positioned on said elongate body in a manner effective such that said bow springs will remain in contact with said interior wall to center said plunger while allowing said plunger to descend gravitationally within said interior wall.

14. The plunger of claim 7 wherein said actuator comprises a plurality of legs extending radially from said valve rod through apertures provided in said elongate body.

* * * * *